US008464543B2

(12) United States Patent
Visin et al.

(10) Patent No.: US 8,464,543 B2
(45) Date of Patent: Jun. 18, 2013

(54) DOOR MOUNTED ICE LEVEL DETECTION DEVICE

(75) Inventors: Jerold M. Visin, Benton Harbor, MI (US); Guolian Wu, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 709 days.

(21) Appl. No.: 12/719,045

(22) Filed: Mar. 8, 2010

(65) Prior Publication Data

US 2011/0214442 A1 Sep. 8, 2011

(51) Int. Cl.
*F25C 1/00* (2006.01)
*F25C 5/18* (2006.01)

(52) U.S. Cl.
USPC ..... 62/137; 62/344

(58) Field of Classification Search
USPC ..... 62/137, 344, 449, 377, 135
See application file for complete search history.

(56) References Cited

U.S. PATENT DOCUMENTS

| | | | |
|---|---|---|---|
| 3,926,007 | A | 12/1975 | Braden et al. |
| 4,872,318 | A | 10/1989 | Klemmensen |
| 5,160,094 | A | 11/1992 | Willis et al. |
| 6,050,097 | A | 4/2000 | Nelson et al. |
| 6,334,319 | B1 | 1/2002 | Senner |
| 6,438,976 | B2 | 8/2002 | Shapiro et al. |
| 6,442,954 | B1 | 9/2002 | Shapiro et al. |
| 6,945,068 | B2 | 9/2005 | Kim et al. |
| 6,964,177 | B2 | 11/2005 | Lee et al. |
| 7,017,363 | B2 | 3/2006 | Lee et al. |
| 7,076,967 | B2 | 7/2006 | Lee et al. |
| 7,222,498 | B2 | 5/2007 | Lee et al. |
| 2007/0186571 | A1 | 8/2007 | Kopf |
| 2009/0255279 | A1 | 10/2009 | Kim et al. |
| 2009/0255280 | A1 | 10/2009 | Kim et al. |
| 2009/0255283 | A1 | 10/2009 | Kim et al. |
| 2009/0272130 | A1 | 11/2009 | Kim et al. |

*Primary Examiner* — Chen Wen Jiang
(74) *Attorney, Agent, or Firm* — Kirk W. Goodwin; McKee, Voorhees & Sease PLC

(57) ABSTRACT

An ice level detection device of a refrigerator includes an ice level detection arm and an ice storage container detection arm, the ice level detection arm operatively connected to a mechanical motor for movement between an ice sensing position with the ice level detection arm extending at least partially into the ice storage container and an ice harvest position with the ice level detection arm being clear of the ice storage container, the ice storage container detection arm abutting the ice storage container while the ice storage container is mounted at the door. The ice level detection arm transitions from the ice sensing position to the ice harvest position for ice harvest by the ice maker. Opening the door disables ice harvest by the ice maker. Upon removal of the ice storage container the ice level detection arm transitions to the ice harvest position and disables ice harvest.

15 Claims, 9 Drawing Sheets

DOOR MOUNTED ICE LEVEL DETECTION DEVICE

FIELD OF THE INVENTION

The present invention relates to refrigerators. More particularly, but not exclusively, the present invention relates to an ice level detection device assembly.

BACKGROUND OF THE INVENTION

Refrigerators often include automatic ice makers for making ice and depositing the ice in an ice container. When making ice with an automatic ice maker there is a need to determine and detect the level of the ice in the ice container to stop the production of ice so as to avoid overflow of the ice container. If the refrigerator is configured to have the ice container on the door such as in side-by-side configurations, there is a need to stop the ice production when the door is open as to not have ice falling to the floor instead of into the ice container.

Currently ice detection devices have been both mechanical arms attached directly to the icemaker itself or as in the case of an automatic icemaker with the ice container on the door, an infrared emitter and receiver remotely attached to the freezer compartment. Although the infrared system is a very effective way of ice level detection, it is also a costly system. Therefore, what is needed is a refrigerator with an improved ice level detection.

BRIEF SUMMARY OF THE INVENTION

Therefore, it is a primary object, feature or advantage of the present invention to improve over the state of the art.

It is a further object, feature, or advantage of the present invention to provide an ice level detection system that is suitable for use on the door of a refrigerator.

It is a still further object, feature, or advantage of the present invention to provide an ice level detection system that is also able to detect the presence or absence of an ice container.

Yet a still further object, feature, or advantage of the present invention is to provide an ice level detection system that does not harvest ice when the ice container is mounted on a door of the refrigerator and the door is open.

One or more of these and/or other objects, features, or advantages of the present invention will become apparent from the specification and claims that follow. No single embodiment of the present invention need achieve each and every one of these objects, features, and advantages.

According to one aspect of the present invention, a refrigerator is provided. The refrigerator includes a refrigerator cabinet, a door for providing access to a compartment within the refrigerator cabinet, an ice maker disposed in the compartment, an ice storage container removably mounted about an inside of the door, and an ice level detection device operatively mounted on the inside of the door adjacent the ice storage container. The ice level detection device includes an ice level detection arm and an ice storage container detection arm, the ice level detection arm is operatively connected to a mechanical motor for movement between an ice sensing position with the ice level detection arm extending at least partially into the ice storage container and an ice harvest position with the ice level detection arm being clear of the ice storage container. The ice storage container detection arm abuts the ice storage container while the ice storage container is mounted about the inside of the door. The ice level detection arm transitions from the ice sensing position to the ice harvest position for ice harvest by the ice maker. Opening the door disables ice harvest by the ice maker. Upon removal of the ice storage container the ice level detection arm transitions to the ice harvest position and disables ice harvest by the ice maker.

According to another aspect of the present invention, an ice level detection device for use on an inside of a refrigerator door and adjacent to an ice storage container is provided. The ice level detection device includes an ice level detection arm and an ice storage container detection arm. The ice level detection arm being operatively connected to a mechanical motor for movement between an ice sensing position with the ice level detection arm extending at least partially into the ice storage container and an ice harvest position with the ice level detection arm being clear of the ice storage container. The ice storage container detection arm abutting the ice storage container while the ice storage container is mounted about the inside of the door. The ice level detection arm transitions from the ice sensing position to the ice harvest position for ice harvest by the ice maker. Opening the door disables ice harvest by the ice maker. Upon removal of the ice storage container the ice level detection arm transitions to the ice harvest position and disables ice harvest by the ice maker.

According to another aspect of the present invention, a refrigerator is provided. The refrigerator includes a refrigerator cabinet and a door for providing access to a compartment within the refrigerator cabinet. There is an ice storage container removably mounted on the inside of the door. There is also an ice level detection arm, an ice storage container detection arm, and a mechanical motor. The ice level detection arm is operatively connected to the mechanical motor for movement between an ice sensing position with the ice level detection arm extending at least partially into the ice storage container and an ice harvest position with the ice level detection arm being clear of the ice storage container. The ice storage container detection arm abuts the ice storage container while the ice storage container is mounted about the inside of the door. There is a first switch associated with the ice level detection arm. There is a second switch associated with the ice storage container detection arm. The ice level detection arm transitions from the ice sensing position to the ice harvest position for ice harvest by the ice maker. Opening the door disables ice harvest by the ice maker. Upon removal of the ice storage container the ice level detection arm transitions to the ice harvest position and disables ice harvest by the ice maker.

Other aspects, features and details of the present invention can be more completely understood by reference to the following detailed description in conjunction with the drawings, and from the appended claims.

DETAILED DESCRIPTION OF THE PREFERRED EMBODIMENT

Figure 1:
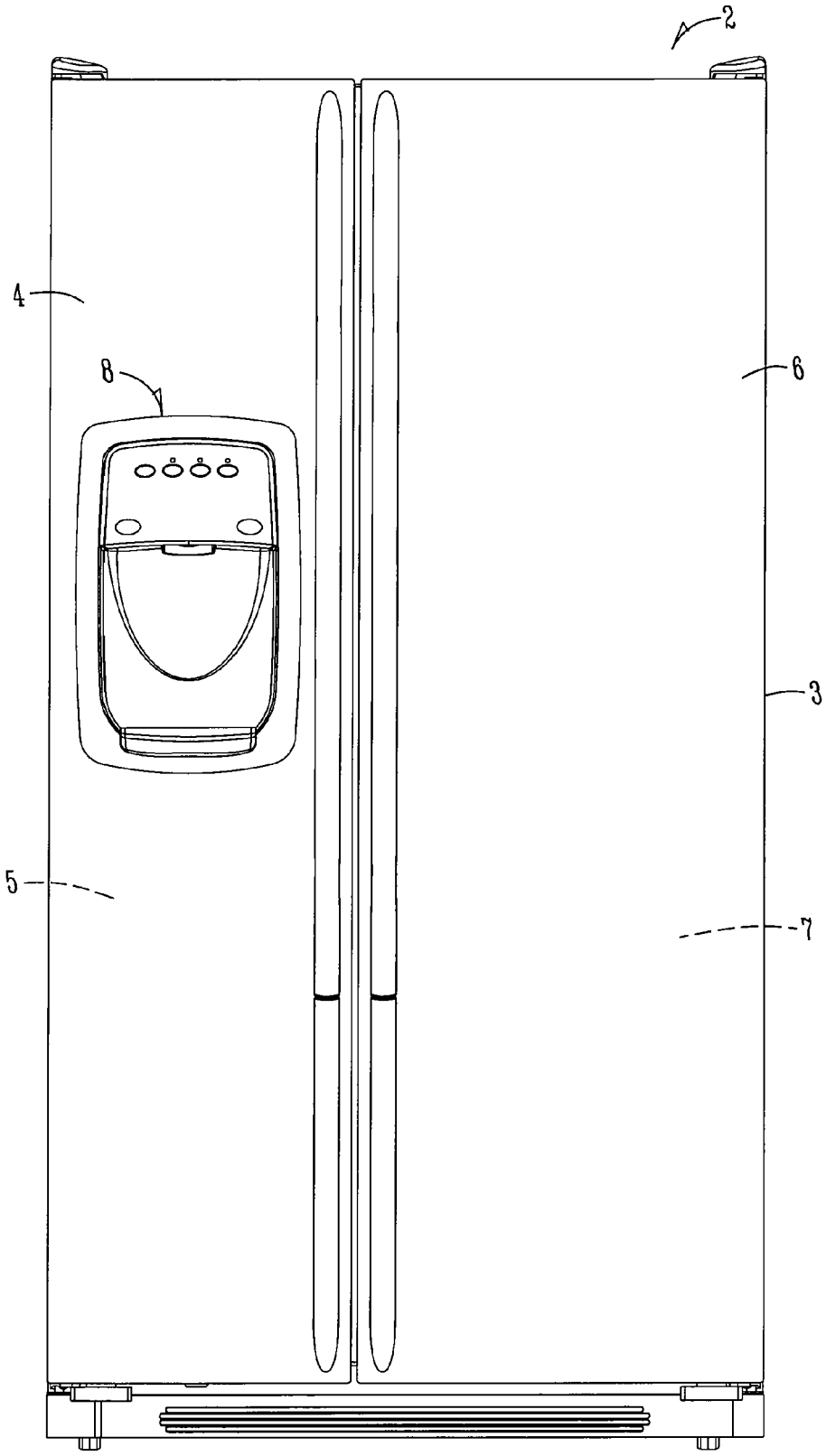
FIG. 1 is a perspective view of a refrigerator.

FIG. 1 is a perspective view of one embodiment of a refrigerator 2. The refrigerator 2 shown is in a side-by-side configuration. The refrigerator 2 has an insulated cabinet 3. A freezer compartment door 4 provides access to a freezer compartment 5. A fresh food compartment door 6 provides access to a fresh food compartment 7. A water and ice dispenser 8 is shown on the freezer compartment door 4.

Figure 2:
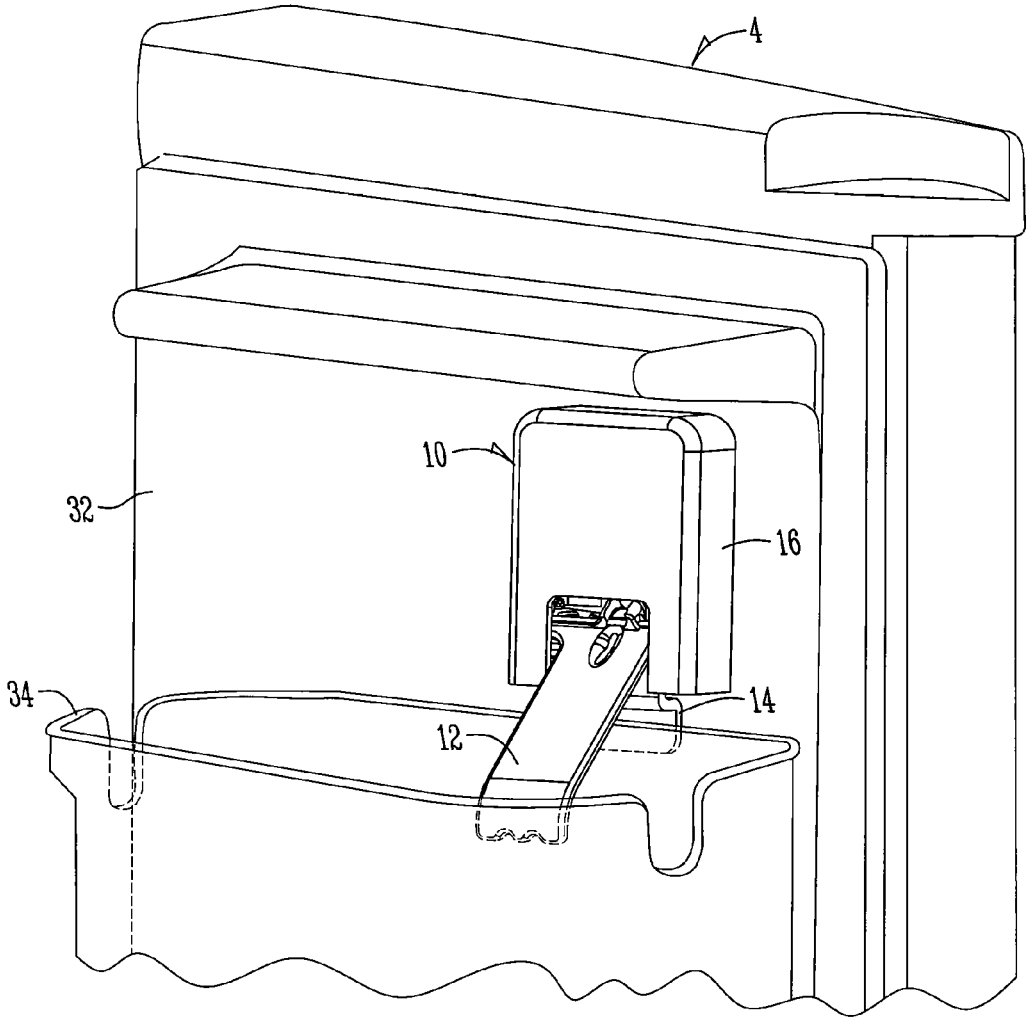
FIG. 2 is an isometric view of an ice level detection assembly.

In FIG. 2 an ice level detection assembly 10 is shown. The ice level detection assembly 10 may be mounted to an inside liner 32 of a freezer door 4. The ice level detection assembly 10 includes an ice level detection arm 12, an ice container in/out detection arm 14, and a bail cover 16. In operation, the ice level detection assembly 10 will raise the ice level detection arm 12 up and out of the ice container 34 when ice harvesting is desired. The ice level detection arm 12 is lowered in to the ice container 34 to sense the ice level. Ice production is halted if the ice level detection arm 12 is not allowed to be fully lowered into the ice container 34 which is due to a full ice container 34.

Figure 3:
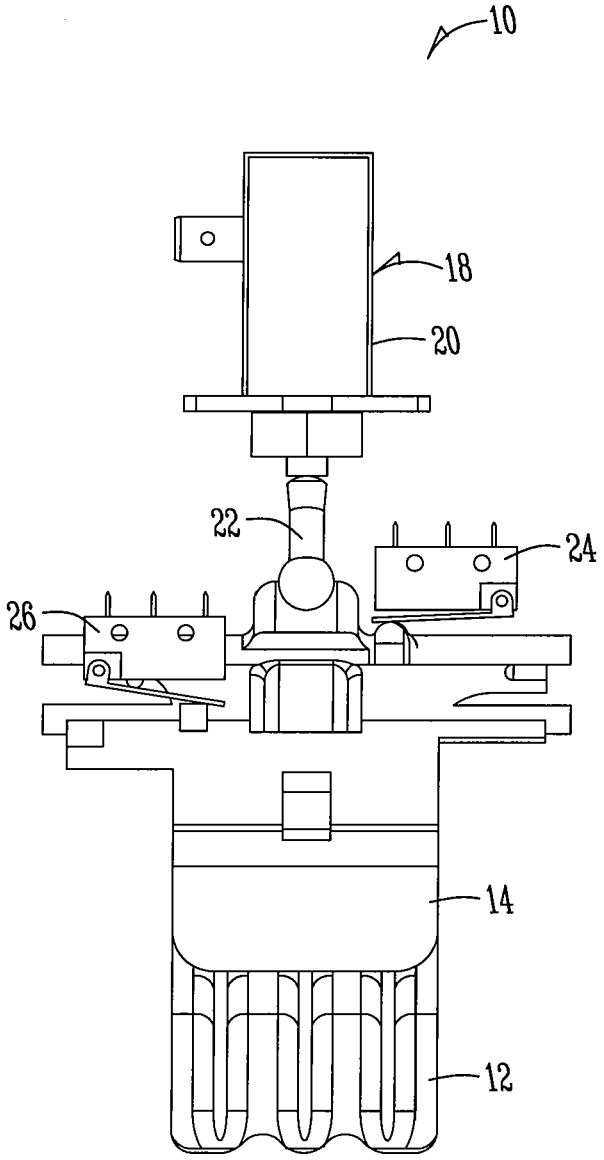
FIG. 3 is a back view of the ice level detection assembly minus the cover and back plate.

In FIG. 3, the ice level detection assembly 10 is shown from the rear but without a door bracket or bail cover. The ice level detection assembly 10 includes a wax motor assembly 18. The ice level detection arm 12 is raised and lowered by a wax motor assembly 18. Wax motors may have various advantages as compared to a solenoid such as: the wax motor actuation is not instantaneous, but rather, smooth and gentle; and the wax motor is a resistive load rather than an inductive load and therefore does not require a snubber circuit to protect the control circuit from transient voltage. Wax motors tend to endure situations where the plunger or piston is blocked from full travel. The wax motor assembly 18 includes a wax motor 20 and a wax piston 22. Also, in FIG. 3 are two cherry switches 24 and 26. Cherry switch 24 is associated with the ice level detection arm 12. Cherry switch 26 is associated with the ice container in/out detection arm 14.

Figure 4:
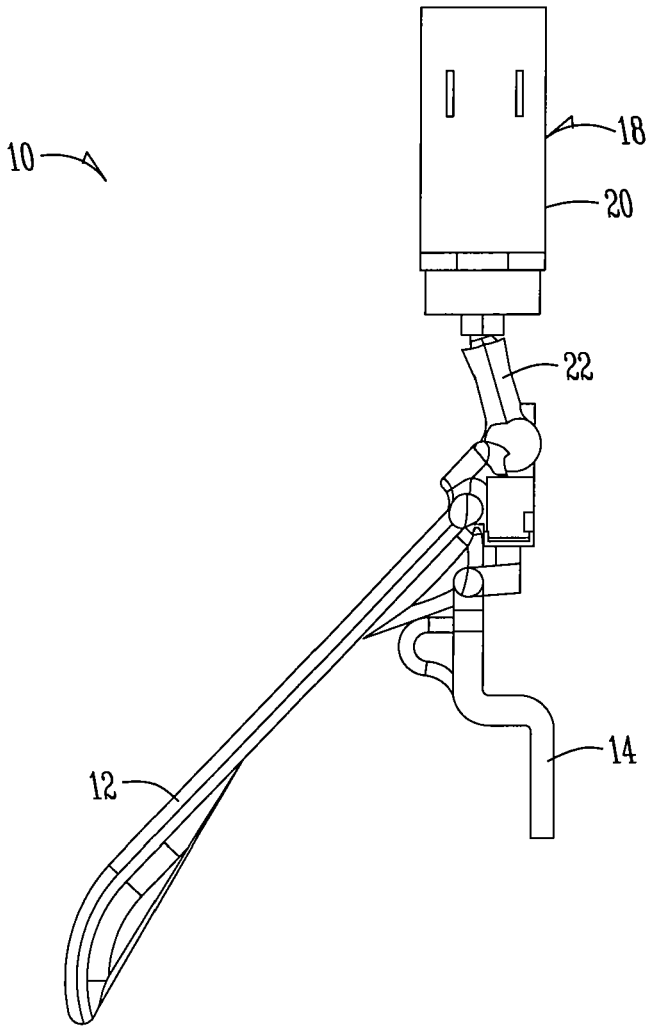
FIG. 4 is a right side view of the ice level detection assembly in the idle position.

As shown in FIG. 4, when the ice level detection arm 12 and the ice container in/out detection arm 14 are both at their lowest point of travel, the cherry switches 24 and 26 are not actuated and thus the ice level detection assembly 10 is placed in an idle state. This position allows for the icemaker to keep producing ice to fill ice container 34. Also, the wax piston 22 is retracted back towards the wax motor 20 body.

Figure 5:
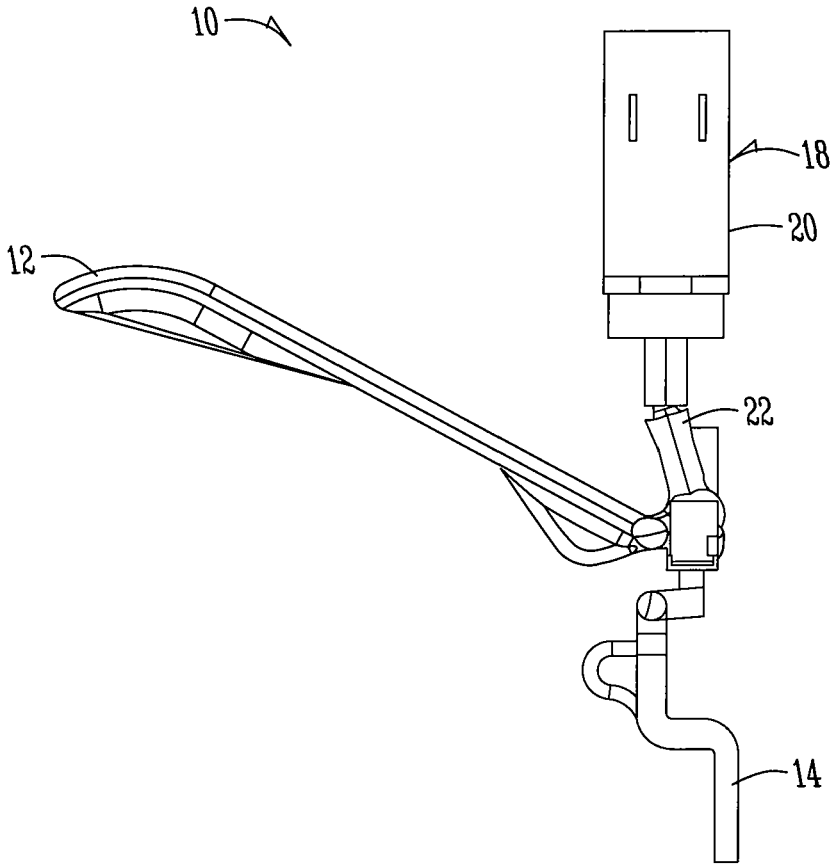
FIG. 5 is a right side view of the ice level detection assembly in the harvest position.
Figure 6:
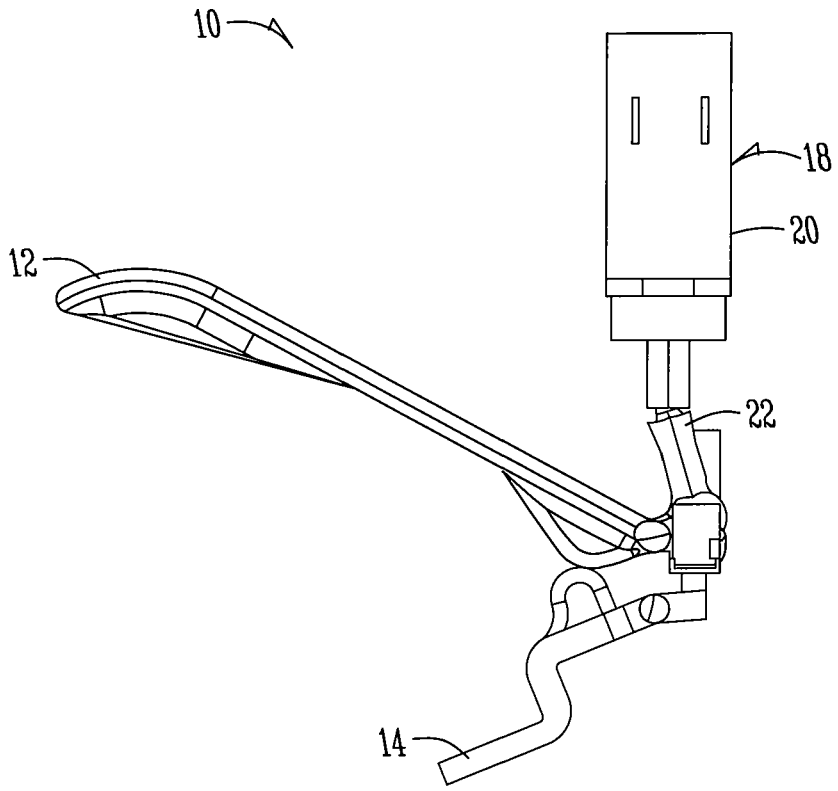
FIG. 6 is a right side view of the ice level detection assembly wherein an ice container is removed.

When a request for ice is received, wax motor 20 is energized effecting wax piston 22 to extend away from the wax motor 20 body. Wax piston 22 is operatively connected to the pivot end of ice level detection arm 12. As the wax piston 22 extends, it forces ice level detection arm 12 to rotate up and out of ice container 34. When the ice level detection arm 12 is in the upward position as can be seen in FIG. 5, the icemaker temporarily stops producing ice and allows ice harvesting to occur.

Figure 7:
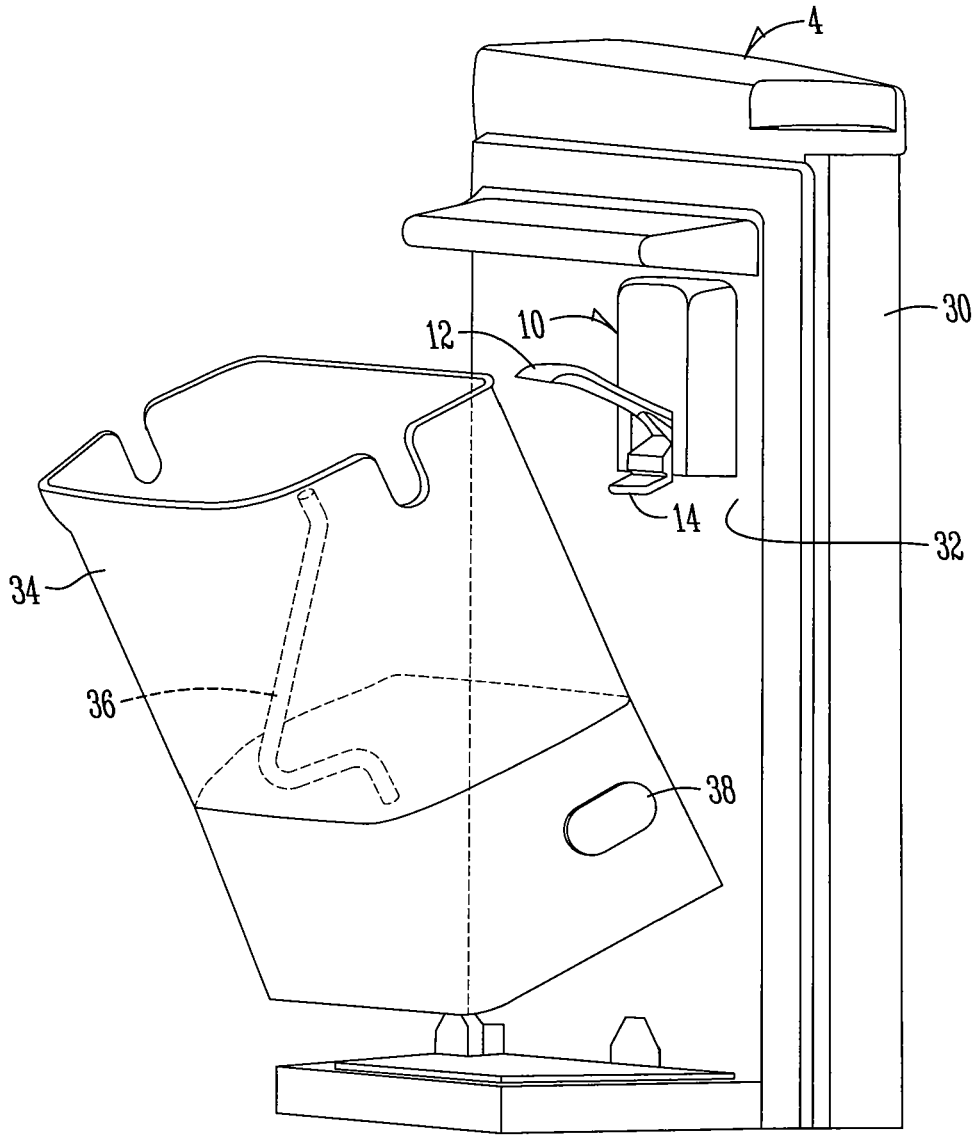
FIG. 7 is an isometric view of the ice level detection assembly and the ice container in a non-ice harvesting position, such as when the ice container is removed.

As shown in FIG. 7, the ice container 34 can be removed by pressing the release button 38 (one on each side). As the ice container 34 is being removed the spring loaded (spring not shown) ice container in/out detection arm 14 will rotate from the vertical position to a mostly horizontal position lifting the ice level detection arm 12 to its farthest upward position clear of the ice container 34 and the icemaker temporarily stops producing ice. When the ice container in/out detection arm 14 is in the mostly horizontal position the control system will indicate that the ice container 34 has been removed via the interaction of ice container in/out detection arm 14 and cherry switch 24 and ice production will stop via the interaction between ice level sensor arm 12 and cherry switch 26. Also, opening freezer door 4 will disable ice harvesting.

Figure 8:
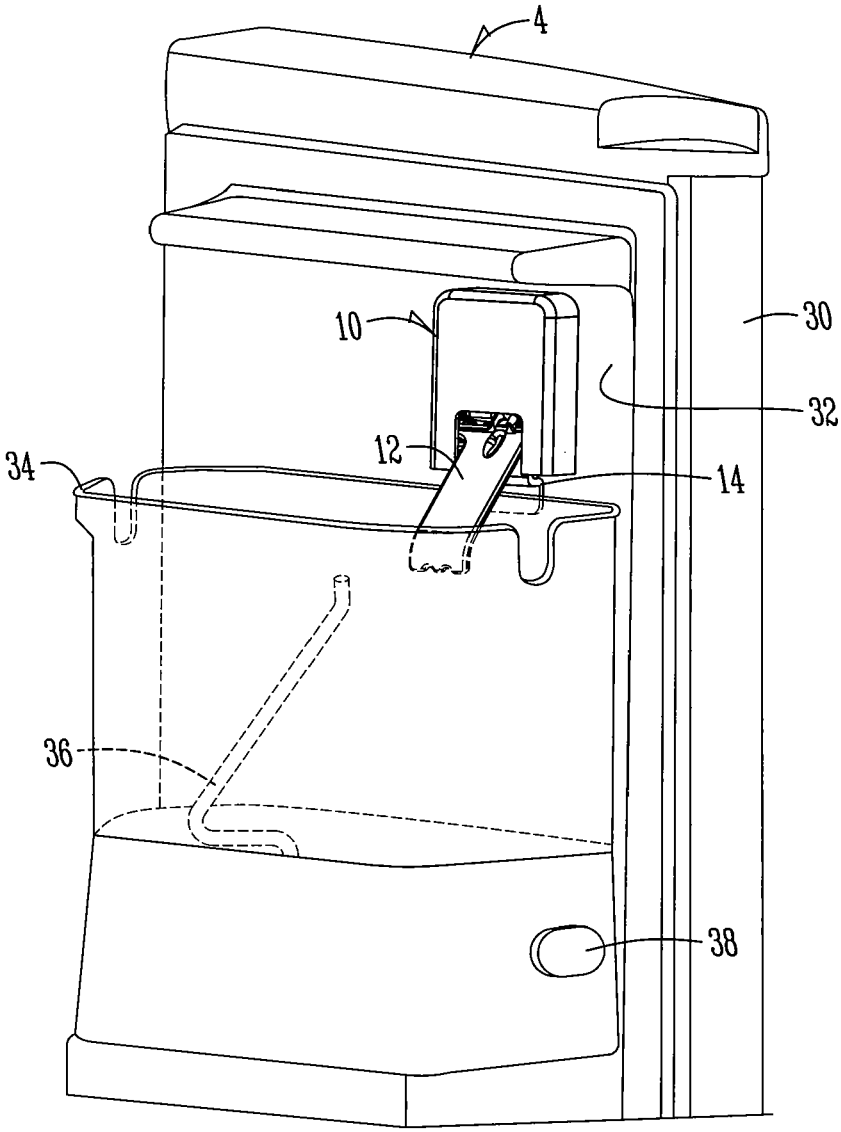
FIG. 8 is an isometric view of the ice level detection assembly and the ice container in position for ice harvesting.
Figure 9:
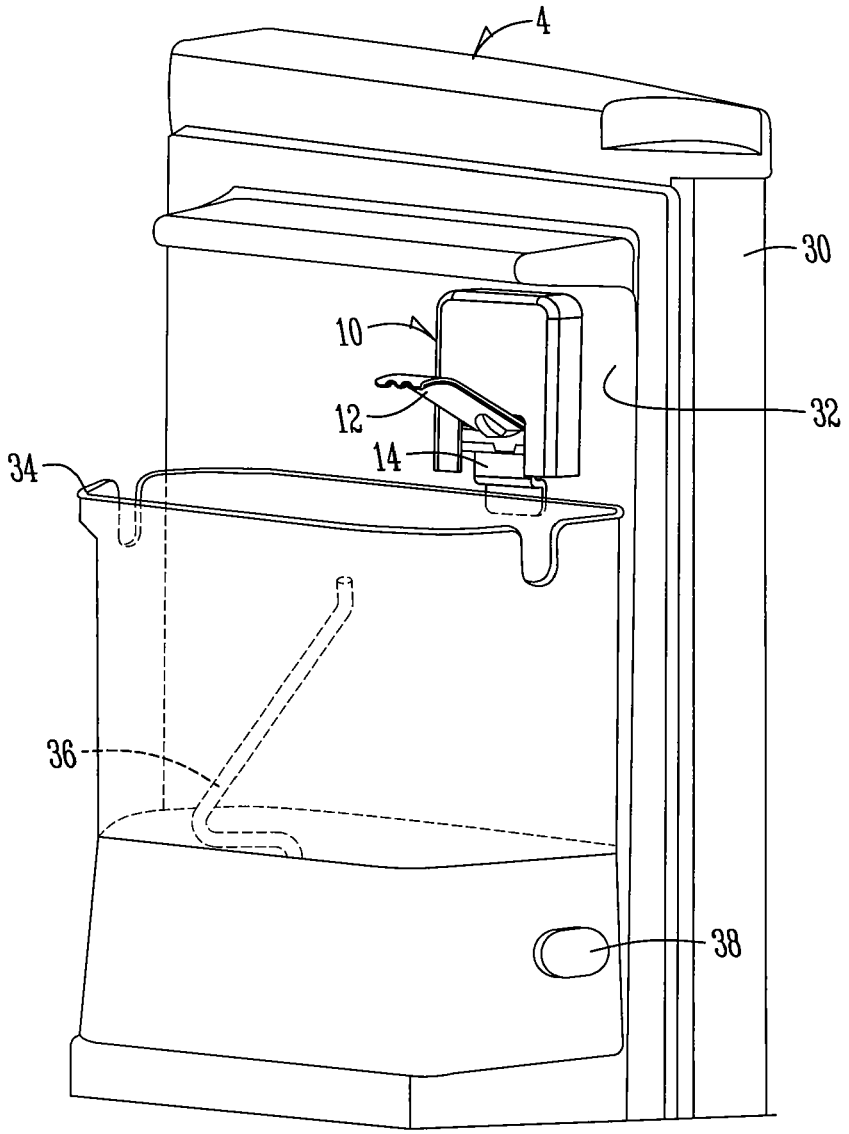
FIG. 9 is an isometric view of an ice level detection assembly in an idle position.

FIG. 8 illustrates the ice container 34 in position at the door. The ice level detection arm 12 is in an idle position. As shown in FIG. 9, the ice level detection arm 12 is in the up position or harvesting position. The ice level detection arm 12 is also raised up and clear of the ice container 34 to allow the auger 36 to spin, thus keeping the ice free flowing for harvesting via an ice dispenser which is in communication with the freezer door 4 exterior surface 30.

The invention has been shown and described above, and it is understood that many modifications, substitutions, and additions may be made which are within the intended spirit and scope of the invention. For example, although shown on the inside of a freezer compartment door, the ice level detection assembly need not be attached to the door. In addition, the ice level detection assembly may also be used in refrigerators where ice is made at the fresh food compartment door. By way of further example, although a wax motor is used in the embodiment shown, instead solenoids or other types of mechanical motors or other devices may be used. These and other variations, options, and alternatives may be used with the present invention.

What is claimed is:

1. A refrigerator comprising:

a refrigerator cabinet;

a door for providing access to a compartment within the refrigerator cabinet;

an ice maker disposed in the compartment;

an ice storage container removably mounted about an inside of the door; and an ice level detection device operatively mounted on the inside of the door adjacent the ice storage container and having an ice level detection arm and an ice storage container detection arm, the ice level detection arm being operatively connected to a mechanical motor for movement between an ice sensing position with the ice level detection arm extending at least partially into the ice storage container and an ice harvest position with the ice level detection arm being clear of the ice storage container, the ice storage container detection arm abutting the ice storage container while the ice storage container is mounted about the inside of the door;

wherein the ice level detection arm transitions from the ice sensing position to the ice harvest position for ice harvest by the ice maker;

wherein opening the door disables ice harvest by the ice maker;

wherein upon removal of the ice storage container the ice level detection arm transitions to the ice harvest position and disables ice harvest by the ice maker.

2. The refrigerator of claim 1 wherein the mechanical motor is a wax motor.

3. The refrigerator of claim 1 wherein the door is a freezer door and the compartment is a freezer compartment.

4. The refrigerator of claim 1 wherein the mechanical motor has a piston operatively connected to the ice level detection arm.

5. The refrigerator of claim 1 further comprising a first switch associated with the ice level detection arm.

6. The refrigerator of claim 1 further comprising a second switch associated with the ice storage container detection arm.

7. An ice level detection device for use on an inside of a refrigerator door and adjacent to an ice storage container, the ice level detection device comprising:

an ice level detection arm;

an ice storage container detection arm;

the ice level detection arm being operatively connected to a mechanical motor for movement between an ice sensing position with the ice level detection arm extending at least partially into the ice storage container and an ice harvest position with the ice level detection arm being clear of the ice storage container;

the ice storage container detection arm abutting the ice storage container while the ice storage container is mounted about the inside of the door;

wherein the ice level detection arm transitions from an ice sensing position to the ice harvest position for ice harvest by the ice maker;

wherein opening the door disables ice harvest by the ice maker;

wherein upon removal of the ice storage container the ice level detection arm transitions to the ice harvest position and disables ice harvest by the ice maker.

8. The ice level detection device of claim 7 wherein the mechanical motor is a wax motor.

9. The ice level detection device of claim 7 wherein the mechanical motor has a piston operatively connected to the ice level detection arm.

10. The ice level detection device of claim 7 further comprising a first switch associated with the ice level detection arm.

11. The ice level detection device of claim 7 further comprising a second switch associated with the ice storage container detection arm.

12. A refrigerator comprising:

a refrigerator cabinet;

a door for providing access to a compartment within the refrigerator cabinet;

an ice storage container removably mounted on the inside of the door;

an ice level detection arm;

an ice storage container detection arm;

a mechanical motor;

the ice level detection arm being operatively connected to the mechanical motor for movement between an ice sensing position with the ice level detection arm extending at least partially into the ice storage container and an ice harvest position with the ice level detection arm being clear of the ice storage container;

the ice storage container detection arm abutting the ice storage container while the ice storage container is mounted about the inside of the door;

a first switch associated with the ice level detection arm;

a second switch associated with the ice storage container detection arm;

wherein the ice level detection arm transitions from the ice sensing position to the ice harvest position for ice harvest by an ice maker;

wherein opening the door disables ice harvest by the ice maker;

wherein upon removal of the ice storage container the ice level detection arm transitions to the ice harvest position and disables ice harvest by the ice maker.

13. The refrigerator of claim 12 wherein the mechanical motor is a wax motor.

14. The refrigerator of claim 12 wherein the door is a freezer door and the compartment is a freezer compartment.

15. The refrigerator of claim 12 wherein the mechanical motor has a piston operatively connected to the ice level detection arm.

* * * * *